US005340365A

United States Patent [19]

Wehling et al.

[11] Patent Number: 5,340,365

[45] Date of Patent: Aug. 23, 1994

[54] PROCESS FOR PRODUCING CHROME LEATHER

[75] Inventors: Bernhard Wehling; Franz Schade, both of Bergisch Gladbach; Joachim Kochta, Bonn; Herbert Burkhardt, Hemsbach; Peter Schindlmayr, Rheinbach, all of Fed. Rep. of Germany

[73] Assignee: Bayer Aktiengesellschaft, Leverkusen, Fed. Rep. of Germany

[21] Appl. No.: 942,651

[22] Filed: Sep. 9, 1992

[30] Foreign Application Priority Data

Sep. 19, 1991 [DE] Fed. Rep. of Germany ..... 4131202

[51] Int. Cl.[5] ..... C14C 1/00; C14C 1/08

[52] U.S. Cl. ..... 8/94.18; 8/94.27

[58] Field of Search ..... 8/94.18, 94.24, 94.21, 8/94.27; 252/8.57

[56] References Cited

U.S. PATENT DOCUMENTS

| | | | |
|---|---|---|---|
| 3,519,378 | 7/1970 | Luck et al. | 8/94.24 |
| 3,906,037 | 9/1975 | Schade et al. | 8/94.24 |
| 4,060,384 | 11/1977 | Siegler | 8/94.27 |
| 4,963,156 | 10/1990 | Hinley | 8/94.29 |

FOREIGN PATENT DOCUMENTS

| | | | |
|---|---|---|---|
| 0429830 | of 0000 | European Pat. Off. . | |
| 0291165 | 4/1988 | European Pat. Off. . | |
| 1806536 | 11/1068 | Fed. Rep. of Germany . | |
| 332262 | 7/1930 | United Kingdom | 8/94.18 |
| 1110091 | 1/1966 | United Kingdom . | |
| 1220018 | 1/1971 | United Kingdom . | |

OTHER PUBLICATIONS

Hodder et al., Practical Leather Processing Using the Novel Pretan Concept II. Results of Tannery Trials on Side Upper Leather, JALCA, vol. 79, 1984 (pp. 7–8).

J. J. Hodder, JALCA, 1984, pp. 6–15.

William C. Prentiss, *The Leather Manufacturer,* Dec. 1987, pp. 9–16.

JALCA, vol. 78, (no month) 1983, p. 174.

LIRI Research Bull. No. 894, Apr. 1985.

Marcel Siegler, JALCA, Sep. 1979, pp. 288–300.

Abstract of Japanese Patent JP 91/177500, Week 9137, Jan. 8, 1991.

Cynthia Lyndsey, *Leather,* Jun. 1986, pp. 41 & 43.

*Primary Examiner*—John Niebling

*Assistant Examiner*—Edna Wong

*Attorney, Agent, or Firm*—Sprung Horn Kramer & Woods

[57] ABSTRACT

In the production of chrome leather, a pretreatment of delimed and bated pelts with condensation products not having a tanning action leads to substrates which, without any problems, can be mechanically dewatered and shaved or split and shaved.

The properties of the leathers produced therefrom by chrome tanning do not differ from those of leathers which have been conventionally chrome-tanned and shaved.

3 Claims, No Drawings

PROCESS FOR PRODUCING CHROME LEATHER

In the production of chrome leathers, as is usual in practice, pelt material is tanned with commercially available chromium(III) salts after pickling. After mechanical dewatering and splitting, if appropriate, the resulting wet-blue is brought to the desired thickness by shaving.

In this case, large quantities of chromium-containing shavings are obtained, which nowadays cause ecological problems in disposal. The same applies to corresponding trimming wastes.

To overcome this problem, it was proposed in U.S. Pat. No. 4,060,384 to pretan the pelt material without chromium, so that the shrinking temperature of the hides rises to 77–85° C. The appropriately pretanned hide material is then split (in the case of unsplit pelts) and shaved, shavings being obtained which do not contain chromium and are easy to dispose of. The hide material thus pretreated mechanically is then chromium-tanned in the conventional manner. This process is called the wet-white process in practice.

Furthermore, for the pretanning claimed in U.S. Pat. No. 4,060,384, the following tanning substances have, for example, been proposed in the meantime:

- aluminium compounds (for example Leather Manufacturer 105 (1987 ) 12, 9–16, Leder- und Häutemarkt (1985 ) 19, 28–35, JALCA 79 (1984 ) 6 );
- aluminium compounds/titanium compounds (for example EP-A 0,291,165, German Published Specification 3,903,499);
- glutaraldehyde or glutaraldehyde derivatives, optionally in combination with resin/replacement tanning agent (for example German Published Specification 3,935,879, JALCA 78 (1983) 174, LIRI Research Bulletin No. 894 (1985), JALCA 74 (1979) 9, 288–300);
- replacement tanning agents based on bis-(4-hydroxyphenyl)-sulphone (for example EP-A 428,481, Rev. Tech. Ind. Cuir 77 (1985) 5, 161–165 );
- oxazolidines (for example Leather 188 [1986] 4531, 41–43).

The chrome leathers produced with the aid of the substances described above markedly differ in the leather character from conventionally chrome-tanned and shaved leathers with respect to feel (see, for example, Das Leder 37 (1986) 12, 221–224), fullness, softness and dyeability. As experience shows, such serious deviations in the property pattern are not tolerated by the leather manufacturer and/or leather processor.

To avoid such disadvantages in the further processing, it was proposed in the case of the aluminium pretreatment largely to remove the aluminium salts by washing after shaving before the chrome-tanning (see Das Leder 38 (1987) 4, 71–75). This additional working step, however, leads to a pollution of the effluent with aluminium salts, which is not unobjectionable from a toxicological view.

It has now been found, surprisingly, that a pretreatment can also be carried out with special condensation products not having a tanning action, giving a substrate which, without any problems, can be mechanically dewatered and shaved or split and shaved. The hide material pretreated in this way has, after appropriate preservation, unlimited storage stability under conditions usual in practice. The leather subsequently resulting therefrom after chrome-tanning does not differ in its application properties from conventionally chrome-tanned and shaved leathers.

The invention thus relates to a process for producing chrome leather, characterised in that the hide material delimed, bated and pickled in the conventional manner is pretreated in an aqueous liquor with a condensation product not having a tanning action and, after mechanical dewatering, is shaved or (in the case of unsplit pelt material) split and shaved and then chrome-tanned with commercially available chromium(III) salts and aftertreated in the usual way. The usual aftertreatment in general comprises neutralisation, retanning, dyeing and fat-liquoring.

The pretreatment agents used according to the invention are condensation products of aromatic sulphonic acids which do not contain any phenolic hydroxyl groups, for example those of $C_6$–$C_{24}$-aromatics such as of naphthalene, or of diaryl ethers, for example of the ditolyl ethers, preferably of $\beta$-naphthalenesulphonic acid, with formaldehyde. Aromatic sulphonic acids which are preferred for the condensation contain 0.8 to 3 and preferably 1 to 2 sulphonic acid groups per molecule.

The preparation of the condensation products to be used according to the invention is described below, taking $\beta$-naphthalenesulphonic acid/formaldehyde as an example:

1.1 to 1.8 and preferably 1.4 to 1.5 mol of 100% strength sulphuric acid can be used per mole of naphthalene. The sulphonation is as a rule carried out at temperatures from 120 to 160 and preferably 140 to 150° C; it is usually complete within 1 to 3 hours. 0.4 to 0.8 and preferably 0.55 to 0.65 mol of formaldehyde are added (in most cases in the form of its aqueous solution). The condensation can take place at temperatures from 95 to 120° C. and preferably 110 to 120° C.; it is as a rule complete within 2 to 5 hours. Finally, the product is neutralised with alkali metal hydroxide solution to a pH value from 5 to 8 and preferably from 6 to 6.5, or with ammonia to a pH value from 2 to 5 and preferably from 3 to 3.5. In a preferred embodiment, these products are adjusted with 1 to 8 and preferably 3 to 4% by weight, relative to condensation product, of $C_4$-$C_8$-dicarboxylic acid (for example glutaric acid) to an acid number (mg of KOH/g) from 20 to 60.

The condensation products used according to the invention have no tanning action of their own (Bibliothek des Leders [Leather Library , Volume 3, page 65, Umschau-Verlag, Frankfurt/Main, 1st edition 1985) in the sense of a covalent collagen crosslinking, such as is achieved, for example, by polyfunctional aldehydes and isocyanates, or in the sense of a collagen crosslinking by hydrogen bond formation with phenol-containing replacement/vegetable tanning agents, or in the sense of a collagen crosslinking by the formation of complexes of mineral tanning agents.

By means of the treatment with the condensation products used according to the invention, shrinkage temperatures of less than 65° C. are achieved. At the same time, however, they effect an extremely strong dewatering of the hide material on the samming machine and allow problem-free mechanical shaving, without scorching phenomena.

In this case, it proves to be particularly advantageous that the shaved thickness of the hide material thus pretreated is the same as the thickness of the chrome-tanned finished leather and makes additional shaving superfluous.

A further resulting advantage is that the time sequence of this wet-white process largely corresponds to the production rhythym of conventional chrome leather production.

In the process according to the invention, the pelt material obtained by the conventional soaking and liming operations is delimed, bated and adjusted with organic and/or inorganic acids to pH values from 2 to 6 and preferably 2.5 to 4.5 (pickled) in the conventional manner.

The pretreatment is then carried out with 3 to 15 and preferably 4 to 8% by weight (relative to pelt weight) of the above mentioned condensation products, relative to solids content.

After mechanical dewatering, the hides thus pretreated can be perfectly shaved or, in the case of unsplit pelts, split and shaved.

The hides are then chrome-tanned with commercially available chromium(III) salts and finished in the conventional manner.

The finished leathers obtained by the process according to the invention show no differences in the property pattern as compared with conventionally produced chrome leathers. The leathers can be brilliantly dyed and are therefore particularly suitable for producing high-grade aniline leathers for processing to give furniture leathers, shoe upper leathers and garment leathers.

The shavings obtained by the process according to the invention are chromium-free and allow diverse possibilities of disposal.

The condensation products used according to the invention can be used in the spray-dried form or as an aqueous solution.

The condensation products used according to the invention can also be used in combination with other tanning substances. The following may be mentioned as examples:

- inorganic aluminium compounds and/or titanium compounds
- aldehydes
- oxazolidines
- compounds containing phenolic groups, and mixtures of these substances.

The percentage data in the examples which follow relate to the weight, unless otherwise stated.

The dilution ratios mentioned in the examples which follow relate to parts by weight, the larger number always denoting the parts of water.

The concentrations of the acids to be diluted correspond to the manner usual in practice: 85% strength formic acid, 96% strength sulphuric acid.

EXAMPLES

Preparation of the Condensation Product to be Used According to the Invention 1 mol of naphthalene is sulphonated for 3 hours at 145° C. with 1.43 mol of 100% strength sulphuric acid. The sulphonation mixture is allowed to cool slightly and is condensed for 3 hours at 115–117° C. with 0.64 mol of formaldehyde which is used in the form of its 30% strength aqueous solution. The reaction mixture is then allowed to cool to 80° C., and aqueous ammonia is then added up to a pH value of 3.5. 4%, relative to the resulting ammonium salt of the condensation product, of glutaric acid is added to this solution, an acid number of 35 thus being obtained. The product is preferably spray-dried, but it can also be used as a 40–60% strength aqueous solution.

EXAMPLE 1

Production of Furniture Leather a) By the wet-white process

For producing furniture leather, 800 kg of cow-hide pelts (split to 2 mm) limed in the usual manner are first washed in the tanning vessel with 100% (relative to the pelt weight; like all percentage data below) of water at 35° C. for 15 minutes. The liquor is drained off, and deliming is then carried out without liquor with 1.3% of ammonium chloride and 0.4% of citric acid for 45 minutes, 80% of water at 35° C. is added, and pickling with 0.2% of a commercially available bating agent (with 1500 tryptic units) is carried out for 120 minutes (pH value of the liquor 7.7). The cross-section of the pelts no longer gives any red coloration with phenolphthalein. This is followed by washing with 100% of water at 25° C. and the liquor is drained off except for a residual liquor of about 50%. 5 minutes after the addition of 8% of common salt, 0.4% of formic acid (diluted with water 1:10) and, after a further 10 minutes, 0.6% of sulphuric acid (diluted with water 1:10) are added, and pickling is carried out for 180 minutes (pickling pH value 3.4).

5% of the condensation product to be used according to the invention is then added to the pickling liquor. After one hour, 1% of a commercially available synthetic fat is added, and tumbling is continued for 10 hours. The final pH value is 3.4 and the final temperature is 31° C.

After draining off the residual liquor, the wet-whites are unloaded, sammed and, optionally after temporary storage for 24 hours, shaved to 1.0 mm thickness. This gives about 30 kg of chromium-free shavings per 100 kg of pelt used.

300 kg of shaved wet-whites were treated in 250% (relative to shaved weight; like all percentage data below) of water at 35° C. with 1% of a commercially available synthetic fat and tumbled for 15 minutes. 0.5% of formic acid (diluted with water 1:10) are then added, followed after 45 minutes by 11.5% of a commercially available, weakly organic-masked chromium(III) sulphate solution with 15% of chromium(III) oxide and 40% basicity (according to Schorlemmer) and, after a further 15 minutes, by 3% of fat (see above). After a running time of 60 minutes, 0.9% of sodium bicarbonate is added in 3 portions at 30 minute intervals each, and running is continued for 120 minutes (pH=3.4). The liquor is heated to 38° C, and 4% of a commercially available chromium-syntan complex (commercially available chromium-containing synthetic retanning agent with 12% of chromium(III) oxide) is added, 6% of a fat mixture of natural and synthetic fats is added after a running time of 15 minutes, and tanning is completed in 8 hours. The residual liquor has a chromium(III) oxide content of 1.8 g/l, a final pH value of 3.3 and a final temperature of 35° C. In the usual manner, the leather is then neutralised to pH 6.5, fat-liquored and finished via intermediate drying.

b) according to chrome-tanning as usual in practice

The pelts (shaved thickness 2 mm) dell/ned, bated and pickled in Example 1*a*) are treated in the pickling liquor with 2.3% (relative to pelt weight, like all percentage data below) of a commercially available synthetic fat and, after 15 minutes, 9% of a commercially available, weakly organic-masked chromium(III) sulphate solution with 15% of chromium(III) oxide and 40% basicity (according to Schorlemmer) is added. After a running time of 90 minutes, 0.35% of magnesium oxide is added, and tumbling is continued for 10 hours. The final pH value is 3.8 and the final temperature is 38° C. The chromium(III) oxide content of the residual liquor is 5.9 g/1.

The resulting wet-blues (with about 3.8% of chromium(III) oxide, relative to water-free wet-blue) are sammed and shaved to 1.0 mm thickness. The shaved wet-blues have the same chromium(III) oxide content as the wet-whites chrome-tanned in Example la) after shaving. Per 100 kg of pelt used, this gives about 28 kg of chrome shavings with about 3.8% of chromium(III) oxide, relative to water-free chrome shavings. In the usual manner, the leather is then neutralised to pH 6.5, fatted and finished via intermediate drying.

The following table compares the chromium emissions of the two processes.

| | Data per 100 kg of pelt processed | | | | |
|---|---|---|---|---|---|
| | Residual tanning liquor | | Shavings Quantity | Chromium content | Total quantity of chromium |
| | Quantity (1) | Chromium content (2) | (cal. as solid) (3) | (4) | Σ (2) + (4) |
| 1a) Wet-white | 60 l | 0 g | about 12 kg | 0 g | 0 g |
| 1b) Wet-blue | 60 l | about 5.9 g/l = 354 g | about 11.2 kg | 426 g | 780 g |

EXAMPLE 2

Production of Furniture Leather

For producing furniture leather, the wet-white leather produced in Example 1*a*) is sammed and shaved. 100 kg of shaved wet-whites are treated in 250% of water (relative to the shaved weight; like all percentage data below) with 1.5% of a commercially available synthetic fat and tumbled for 15 minutes. 0.4% of formic acid (diluted with water 1:10) and, after 45 minutes, 7% of a commercially available chrome-tanning agent with 26% of chromium(III) oxide and 33% basicity (according to Schorlemmer) are added. After a further running time of 15 minutes, 3% of fat (see above) is added. After 60 minutes, 3% of a commercially available, self-basifying chromium-syntan complex with 11% of chromium(III) oxide is added, and running is continued for 150 minutes (pH=3.7). The liquor is heated to 38° C., and 3% of a commercially available chromium-syntan complex with 12% of chromium(III) oxide and, after a running time of 15 minutes, 6% of a fat mixture of natural and synthetic fats are added, and tanning is completed in 8 hours. The residual liquor has a chromium(III) oxide content of 0.9 g/l, a final pH value of 3.6 and a final temperature of 36° C.

In the usual manner, the leather is then neutralised to pH 6.5, fatted and finished via intermediate drying.

EXAMPLE 3

Production of Furniture Leather

For producing furniture leather, pelts limed, delimed and bated as in Example 1*a*) are treated in a 50% liquor after the addition of 8% of common salt with 0.5% of formic acid (diluted with water 1:10) and 0.3% of sulphuric acid (diluted with water 1:10) and pickled for 120 minutes (pickling pH value 3.7).

10% of an aqueous solution (50% strength) of the condensation product to be used according to the invention are then added to the pickling liquor. After one hour, 1.5% of a commercially available synthetic fat is added, and tumbling is continued for 10 hours. The final pH value is 3.7 and the final temperature is 32° C. The residual liquor is chromic-free. The wet-whites are further processed analogously to Example 1*a*).

EXAMPLE 4

Production of Furniture Leather from Unsplit Pelts

For producing furniture leather, 100 kg of cow-hide pelts limed in the usual manner are, in the unsplit state, initially washed twice for 15 minutes with 150% (relative to pelt weight, like all percentage data below) of water at 38° C. The liquor is drained off and deliming is then carried out for 60 minutes without liquor with 2.5% of ammonium sulphate, 0.3% of sodium bisulphite and 0.4% of formic acid (diluted with water 1:10), 40% of water at 35° C. is added, and bating is carried out with 0.5% of a commercially available bating agent (with 1500 tryptic units) for 50 minutes (pH value of the liquor 7.5). The cross-section of the pelts no longer gives any red coloration with phenolphthalein.

This is followed by washing twice with 150% of water at 20° C. and the liquor is drained off except for a residual liquor of about 30%. 5 minutes after the addition of 6% of common salt, 0.5% of formic acid (diluted with water 1:10) and, after a further 10 minutes, 0.7% of sulphuric acid (diluted with water 1:10) are added, and pickling is carried out for 180 minutes (pickling pH value 3.1).

8% of the condensation product to be used according to the invention is then added to the pickling liquor, and tumbling is continued for 10 hours. The final pH value is 3.1 and the final temperature is 32° C.

After draining off the residual liquor, the wet-whites are unloaded, sammed and split to a thickness of 2 mm. This gives about 400 g of chromium-free pelt shavings per kg of pelt.

After 24 hours, the wet-whites are shaved to 1 mm thickness and further processed as in Example 1*a*). It is necessary here, however, to take care that the pH value in the chrome-tanning is raised to about 3.5 by adding 1.1% (instead of 0.9%) of sodium bicarbonate.

EXAMPLE 5

100 kg of cow-hide pelts pretreated as in Example 4 are pickled with 0.5% of formic acid (diluted with water 1:10) (pickling pH value 3.2). The pretreatment is carried out with 17% of an aqueous solution (50% strength) of the condensation product to be used according to the invention. As in Example 4, the wet-whites are then sammed, split and shaved, and further processed as in Example 2.

EXAMPLE 6

Production of Shoe Upper Leather

For producing shoe upper leather, 1000 kg of cow-hide pelts limed in the usual manner (split to about 3.5 mm) are initially washed in the tanning vessel with 150% (relative to pelt weight; like all percentage data below) of water at 38° C. for 10 minutes. The liquor is drained off and deliming is then carried out with 30% of water at 35° C. with 2% of ammonium sulphate, 0.2% of sodium bisulphite and 0.2% of formic acid (diluted with water 1:10) for 30 minutes, and bating is carried out for 30 minutes with 0.5% of a commercially available bating agent (with 1500 tryptic units) (pH value of the liquor 8.3). The cross-section of the pelts no longer gives any red coloration with phenolphthalein. This is followed by washing twice with 150% of water at 20° C. and the liquor is drained off except for a residual liquor of about 20%. 5 minutes after the addition of 5% of con, non salt, 0.5% of formic acid (diluted with water 1:10) and, after 10 minutes, 0.7% of sulphuric acid (diluted with water 1:10) are added, and pickling is carried out for 60 minutes (pickling pH value 3.1).

6% of the condensation product to be used according to the invention and 0.1% of sodium bisulphite (for eliminating $H_2S$) are then added to the pickling liquor. After 1 hour, 1% of a commercially available natural fat (fish oil product) is added, and tumbling is continued for 12 hours.

The final pH value is 3.2 and the final temperature is 31° C. After draining off the residual liquor, the wet-whites are unloaded, sammed and, optionally after temporary storage for 24 hours, shaved to 1.8 mm thickness. This gives about 36 kg of chromium-free shavings per 100 kg of pelt used.

100 kg of shaved wet-whites are treated in 150% (relative to shaved weight; like all percentage data below) of water at 35° C. with 12% of a commercially available, weakly organic-masked chromium sulphate solution with 15% of chromium(III) oxide and 40% basicity (according to Schorlemmer) (pH w 3.1). After 2 hours, 3% of a commercially available, self-basifying chromium-syntan complex with 11% of chromium(III) oxide is added, followed after 2 hours (pH=3.6) by heating to 39° C.

After a running time of 12 hours, the liquor is drained off, 100% of water at 50° C. is added and rechroming is carried out for 60 minutes with 1.5% of a commercially available chrome-tanning agent with 26% of chromium(III) oxide and 33% basicity (according to Schorlemmer)and 2% of the abovementioned chromium-syntan complex (pH=4.1). This is followed by neutralisation with 1.5% of a commercially available neutralisation tanning agent and 0.5% of sodium bicarbonate to pH 4.7 and the liquor is drained off after 45 minutes. The neutralised chrome leathers are retanned in the conventional manner (with a combination of replacement tanning agents, resin tanning agents or polymer tanning agents and vegetable tanning agents), dyed and fatted.

EXAMPLE 7

Production of Shoe Upper Leather

For producing shoe upper leather, 100 kg of cow-hide pelts (split to about 3.5 mm) limed, delimed and bated as in Example 6 are pickled for 60 minutes in 20% (relative to pelt weight, like all percentage data below) of residual liquor after addition of 5% of con, non salt with 0.5% of formic acid (diluted with water 1:10) and 0.7% of sulphuric acid (diluted with water 1:10) (pickling pH value 3.1).

11% of an aqueous solution (50% strength) of the condensation product to be used according to the invention and 0.1% of sodium bisulphite are then added to the pickling liquor. As in Example 6, this is followed by fatting, further tumbling, unloading, samming and shaving.

50 kg of shaved wet-whites are treated in 150% (relative to shaved weight; like all percentage data below) of water at 35° C. with 7% of a commercially available chrome-tanning agent with 26% of chromium(III) oxide and 33% basicity (according to Schorlemmer)(pH=3.0). After two hours, 30% of a commercially available chromium-syntan complex with 15% of chromium(III) oxide is added, and the system is basified with 0.8% of sodiumbicarbonate to pH 3.6. This is followed after 2 hours by heating to 39° C. The further processing and finishing of the leathers is carried out as in Example 6.

EXAMPLE 8

Production of Furniture Leather

For producing furniture leather, 800 kg of cow-hide pelts (split to 2.1 mm) delimed and bated according to Example 1 are pickled in the tanning drum in 50% (relative to pelt weight; like all percentage data below) of residual liquor after addition of 7.5% of common salt and addition 0.4% of formic acid (diluted with water 1:10) after 5 minutes and of 0.5% of sulphuric acid after a further 10 minutes for a total of 180 minutes (pickling pH value 3.5).

4% of the condensation product to be used according to the invention is added to the pickling liquor. After 30 minutes, 0.5% of a commercially available, synthetic replacement tanning agent based on bis-(4-hydroxyphenyl)sulphone is added. After a further 60 minutes, 1.5% of a commercially available synthetic fat is added, and tumbling is continued for 12 hours.

The final pH value is 3.5 and the final temperature is 33° C.

After draining off the residual liquor, the wet-whites are unloaded, sammed and, as in Example 1, shaved, chrome-tanned and finished.

We claim:

1. A process for producing chrome leather from an animal hide comprising deliming, bathing and pickling the hide, pretreating the hide with an aqueous liquor containing a condensation product not capable of tanning comprising the reaction product of a sulphonated aromatic compound with formaldehyde, mechanically dewatering, splitting said hide if not previously split, shaving the hide, and then chrome-tanning the hide.

2. The process according to claim 1, wherein the aromatic compound is naphthalene or a diaryl ether.

3. The process according to claim 1, wherein the aqueous liquor contains 3 to 15% by weight of the condensation product.

* * * * *